US006507266B1

(12) United States Patent
Bizard et al.

(10) Patent No.: US 6,507,266 B1
(45) Date of Patent: Jan. 14, 2003

(54) THERMAL RELAY PROVIDED WITH A SPRING BLADE MECHANISM

(75) Inventors: Bernard Bizard, Shanghai (CN); Daniel Sinthomez, Pont De Pagny (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/808,000

(22) PCT Filed: Nov. 3, 1999

(86) PCT No.: PCT/FR99/02684

§ 371 (c)(1),
(2), (4) Date: May 4, 2001

(87) PCT Pub. No.: WO00/28560

PCT Pub. Date: May 18, 2000

(30) Foreign Application Priority Data

Nov. 5, 1998 (FR) ..... 98 13974

(51) Int. Cl.[7] ..... H01H 37/12; H01H 37/52

(52) U.S. Cl. ..... 337/349; 337/354; 337/335; 337/343; 200/407

(58) Field of Search ..... 337/362, 333, 337/335, 342, 343, 349, 354, 357; 200/407; 29/623; 267/158–165

(56) References Cited

U.S. PATENT DOCUMENTS

| | | | | | |
|---|---|---|---|---|---|
| 3,015,007 | A | * | 12/1961 | Howard | 337/56 |
| 3,872,417 | A | * | 3/1975 | Hufschmid | 200/406 |
| 4,118,610 | A | * | 10/1978 | Purssell et al. | 200/275 |
| 4,250,367 | A | * | 2/1981 | Rossi | 200/275 |
| 4,785,274 | A | * | 11/1988 | Sako et al. | 337/45 |
| 4,908,594 | A | * | 3/1990 | Akiike et al. | 337/45 |
| 5,021,762 | A | * | 6/1991 | Hetrick | 337/103 |
| 5,046,227 | A | * | 9/1991 | Akiike et al. | 200/407 |
| 5,054,754 | A | * | 10/1991 | Akiike et al. | 200/407 |
| 5,191,310 | A | * | 3/1993 | Obermann et al. | 337/103 |
| 5,237,303 | A | * | 8/1993 | Kicherer et al. | 337/361 |
| 5,790,010 | A | * | 8/1998 | Schwab | 200/407 |
| 5,847,636 | A | * | 12/1998 | Sehlhorst | 337/303 |
| 5,877,670 | A | * | 3/1999 | Sehlhorst et al. | 337/302 |
| 6,211,582 | B1 | * | 4/2001 | Reimold et al. | 307/117 |

FOREIGN PATENT DOCUMENTS

| | | | | |
|---|---|---|---|---|
| DE | 38 40 064 | | 5/1990 | |
| EP | 0 360 215 | | 3/1990 | |
| EP | 0 809 270 | | 11/1997 | |
| FR | 1 274 608 | | 2/1962 | |
| JP | 02-213019 A | * | 8/1990 | H01H/61/01 |
| JP | 05-074306 A | * | 3/1993 | H01H/61/01 |
| JP | 08-293241 | * | 4/1995 | H01H/73/22 |
| JP | 02-086024 A | * | 3/1999 | H01H/61/01 |

* cited by examiner

*Primary Examiner*—Anatoly Vortman
(74) *Attorney, Agent, or Firm*—Oblon, Spivak, McClelland, Maier & Neustadt, P.C.

(57) ABSTRACT

The invention concerns an electromechanical protective relay comprising deformable bimetal switches in the event of overload in power lines. A triggering mechanism acts on a flexible blistering segment (20) which can pivot by means of a support (30) on a fixed rest (17) and whereof the stem (21) has an extension (27) formed along the length of the segment and folded back in U- or V-shape to press elastically against a bearing surface (36) of the box so as to cause the segment to exert pressure on the pivot.

6 Claims, 2 Drawing Sheets

THERMAL RELAY PROVIDED WITH A SPRING BLADE MECHANISM

BACKGROUND OF THE INVENTION

The present invention relates to an electromechanical thermal protection relay comprising in a case, components such as thermally deformable bimetal strips in the case of overcurrent in power current lines, as well as switch contacts associated with power lines and able to be actuated by a command element which may be stressed through deformable components.

Usually, the command element acts on a middle point of a thin and flexible blade which has a foot fixed or resting on the case and a head cooperating with a contact maneuvering component. In response to the displacement of the control element resulting from an overcurrent, the stress to which the blade is subject at its middle point causes a sudden displacement of the head from a stable rest position to a working stable position, whereas the foot of the blade substantially remains in its initial position. The blade is designed, made and mounted in order to be able to bow from one stable position to the other, i.e. able to suddenly flex and for this purpose, it has, in its middle portion and for forming an application range for the control element, a protruding finger in a cutout area.

A relay of this type is described in document FR-1 274 608. The prestressing required for bowing the blade is then produced by stiffly fixing and tightening legs provided at the foot of the blade. This embodiment is difficult to reproduce and does not allow the positions of the head to be adjusted.

Another thermal relay of this type is described in document EP-360 215. The prestressing required for bowing the blade is then produced by a bridge of material embossed in the foot of the blade, whereas a stiff support, which may be pivotally applied on a support and stressed by an adjustment screw, is fixed at the foot of the blade. The making of the embossed bridge is particularly difficult to reproduce industrially. Further, the overall dimensions of the blade are observed to be too large in height. Finally the device is not satisfactory since, as the prop of the support is located away in height from the area where the control element is applied on the finger of the blade, it causes, a misadjustment of the control element during an adjustment operation made by means of the screw.

SUMMARY OF THE INVENTION

The object of the invention is to find a remedy to the aforementioned drawbacks and to make the manufacturing characteristics reliable and reproducible, notably the adjustment conditions for a thermal relay of the described type, while providing it with small dimensions.

According to the invention, the foot of the flexible blade has a folded back extension so as to be applied elastically against a span of the case in order to cause the blade to be pressed against the prop.

The extension may notably extend from the foot of the blade in the direction of its length and be folded, beyond the area for fixing the stiff support on the blade, into the shape of a V or U with respect to the main plane of the blade, wherein the free leg of the V or the U is applied against the span of the case. When the blade is symmetrical, the extension may comprise two symmetrical legs.

Preferably, the pivoting rest point of the support of the blade is located along the length of the blade, substantially at the level of the area of application of the control element on the blade.

The adjustment element may have a cam applied on the stiff support of the blade on the side of the pivoting rest point, wherein this cam is able to rotate around an axis parallel to the main plane of the blade.

BRIEF DESCRIPTION OF DRAWINGS

The description of an embodiment of the invention is made hereafter, as a non-limiting example and with reference to the appended drawings.

DETAILED DESCRIPTION

Figure 1:
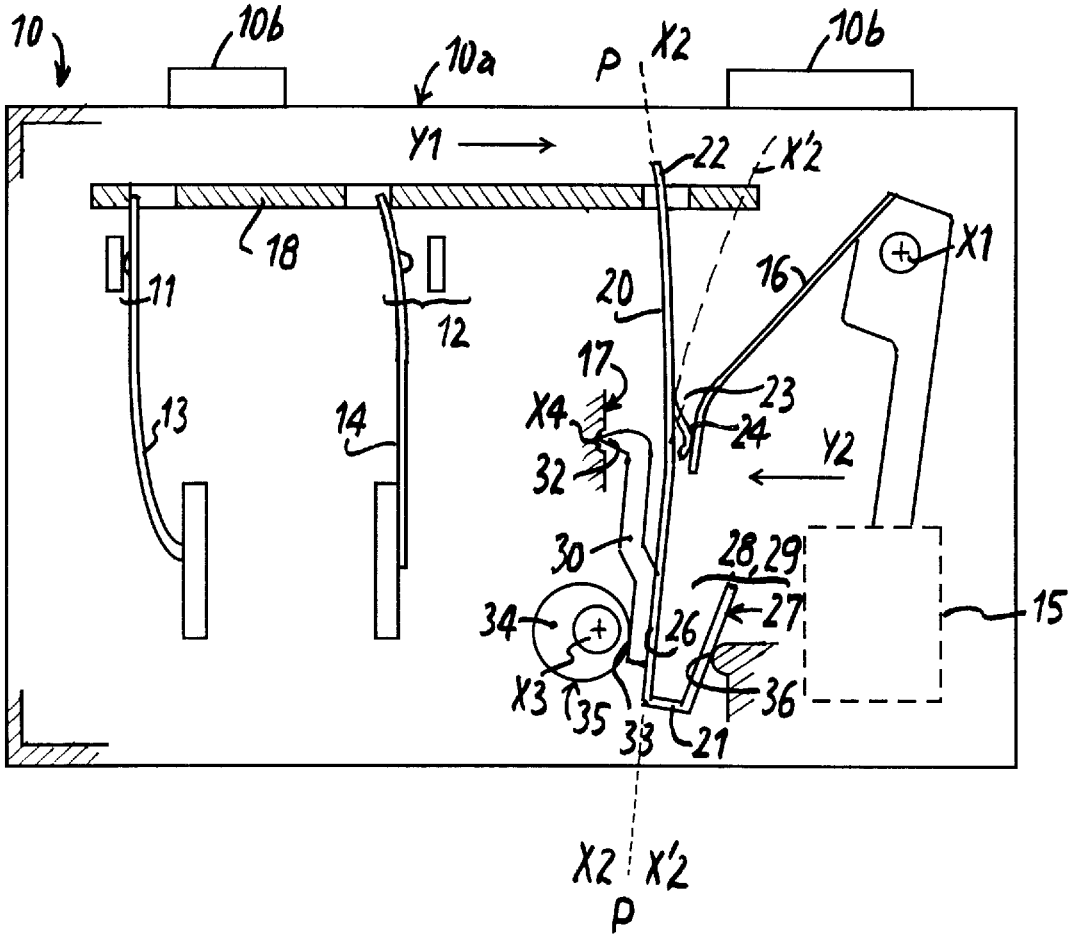
FIG. 1 illustrates a section of the thermal protection relay according to the invention.
Figure 3:
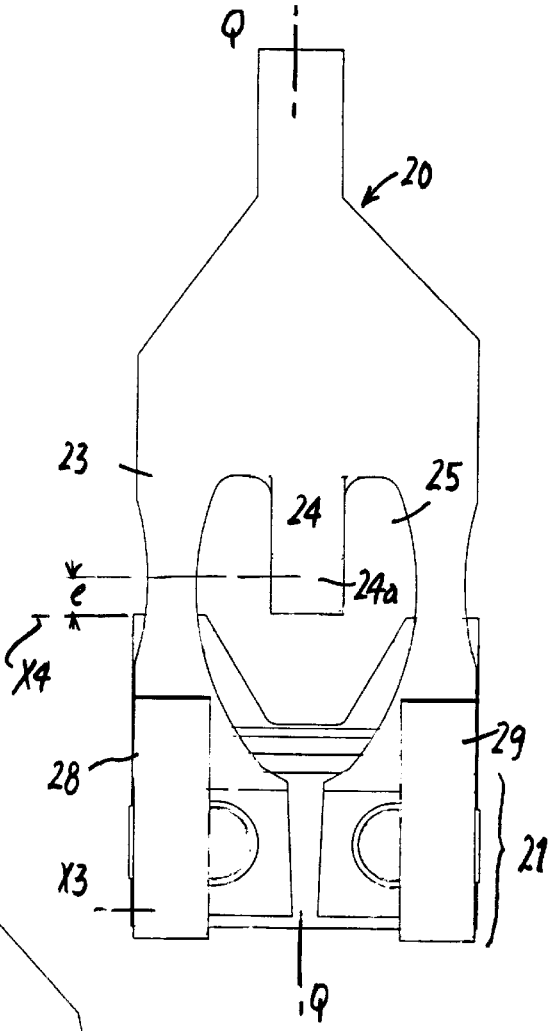
FIGS. 3 and 4 illustrate the blade, as seen in elevation, from the front and from the side, respectively.
Figure 4:
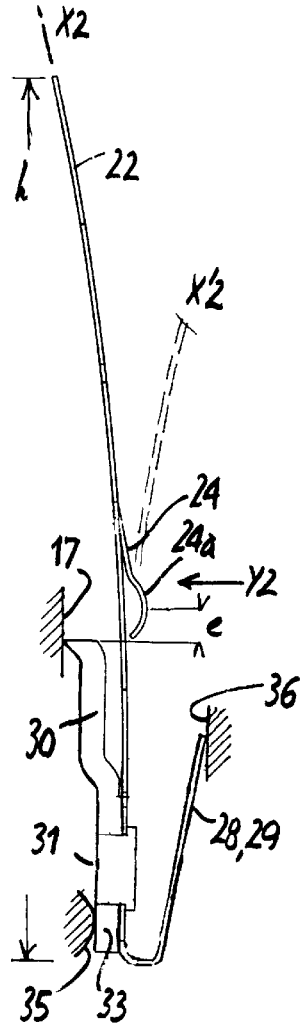
Figure 2:
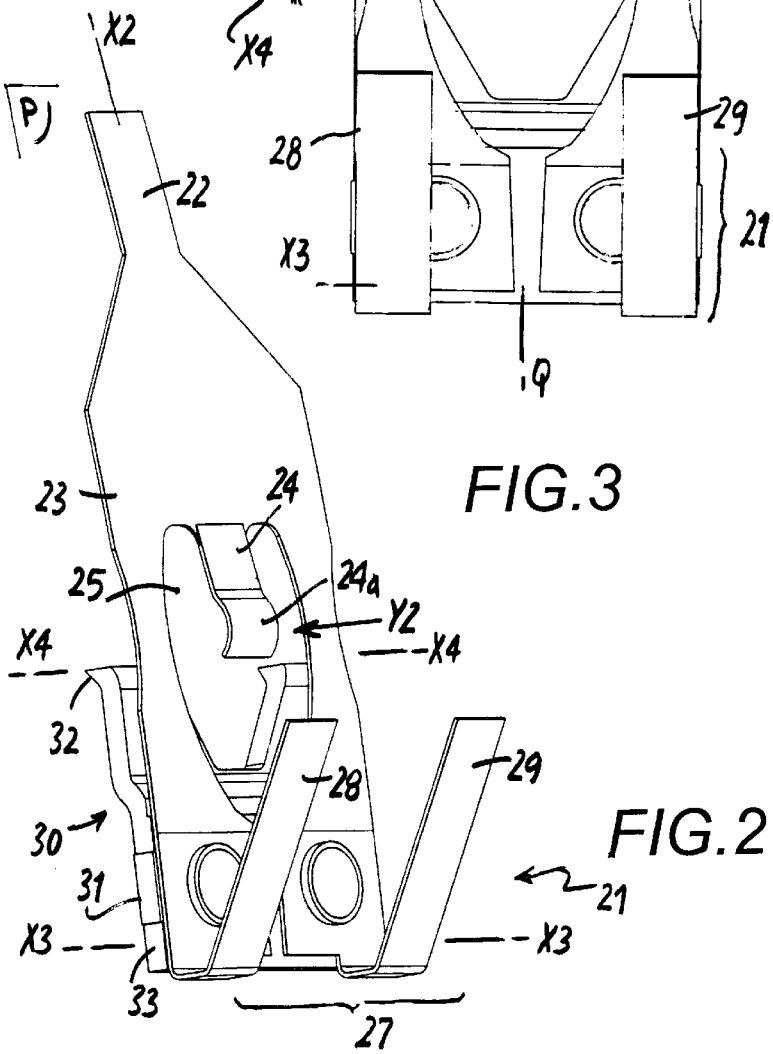
FIG. 2 is a perspective view of the bowing elastic blade of the relay.

The illustrated electromechanical thermal protection relay comprises an insulating case 10 which offers a front face 10*a* provided with maneuvering and adjustment elements 10*b* and which contains bimetal strips not shown, deformable in the case of overcurrent in the power current lines, also not shown.

Case 10 houses pairs of normally closed (NC) switched contacts 11 and normally open (NO) switch contacts 12, the mobile contacts of which are located at the ends of respective elastic blades 13, 14 controllable by a triggering mechanism 15 in response to the deformation of at least a bimetal strip. The triggering mechanism 15 comprises a control element 16 acting on a flexible bowing blade 20 which will act on the contacts. The control element 16 is for example a lever pivoting around an axis X1 and a portion of which is formed by a room temperature compensation bimetal strip.

The flexible blade 20 extends in the direction of its length over a distance h and is symmetrical with respect to a plane Q which defines a main directrix X2 at rest and X'2 in the working position. The general surface of the blade is slightly curved and will be subsequently designated as the main plane P. The blade has a foot 21 resting, via a support 30, on a span 17 of the case, as well as a head 22 and a middle portion 23.

Head 22 of the blade cooperates with a slide 18 for maneuvering the contacts 11, 12 in order to move it along a direction Y1 parallel to the front face 10*a* of the case. The middle portion 23 of the blade, located between the foot 21 and the head 22, is provided with a finger 24, protruding in a cutout region 25. The finger 24 forms an area 24*a* for applying the control lever 16, wherein the latter in the case of an overcurrent, exerts a stress in a direction Y2 parallel to the front face 10*a* of the case and opposite to Y1.

The stiff support 30, as a small plate or analogous element, is fixed by any suitable means to the foot 21 of blade 20. The small plate is positioned on the side of the blade opposite to lever 16 and it has, in its lower portion, a fixing area 31, associated with an area 26 for fixing the foot 21 of the blade, and at its upper portion, a rest point 32 in order to pivot on the fixed span 17 of the case.

Near its lower end 33 and below its fixing area 31, the blade 20 or preferably the small plate 30 is stressed by an adjustment element 34 capable of displacing it along Y1 or Y2. The adjustment element 34 rotates around an axis X3 and offers a cam surface 35 applied on the end 33 of the small plate 30 in order to cause the small plate 30 together with the flexible blade 20 to rotate around the pivot axis X4 defined by the span 17 and the rest point 32, in order to adjust the position of the head 22 of the blade which cooperates with the slide. The adjustment element 34 is easily accessible through the opening of the case before fitting a lid, not shown. Axes X1, X3, X4 are parallel to one another and are perpendicular to Y1, Y2 as well as to the symmetry plane Q of the blade.

According to the invention, foot 21 of the blade 20 is provided with an extension 27 consisting either of a leg, or preferably of two elastic legs 28, 29. The extension 27 is directed from the foot along the length of the blade. Legs 28, 29 are symmetrical with respect to plane Q. Legs 28, 29 are folded back as a V or U through folding, with a fold back angle greater than 135° and here close to 180°, and their free end rests on a span 36 of the case. It is seen that this configuration of the blade reduces the overall dimensions in the length of the blade while producing the targeted pressing of pivot 32 on span 17.

The pivot axis X4 is located, in the direction of the height of the blade, substantially at the level of the rest area 24*a* for finger 24 of the blade, so that adjustment of the position of the head 22 has a very small effect on the rest position of lever 16 and so on the initial condition of the control mechanism. Distance e between axis X4 and area 24*a* may for example be less than 10%, preferably 7%, of the length h of the blade.

Upon assembly, blade 20 is introduced into the case between the pivot prop 17 and span 36 which ensures the compression on prop 17; leg 21 is applied against the adjustment cam 35, whereas the head engages into the slide 18. Lever 16 is applied on area 24*a*. To adjust the position of the head, the operator causes element 34 to rotate until it reaches the desired position, without disturbing the mechanism 15, through the provisions of the invention.

What is claimed is:

1. An electromechanical protection relay comprising in a case, thermally deformable components in the case of an overcurrent in power current lines, switch contacts associated with power lines and able to be actuated by a mechanism with a control element able to be stressed by deformable components and acting on a flexible bowing blade (20) which extends along a main directrix (X2), wherein the flexible blade has:

a foot (21) applied on a prop (17) of the case, a head (22) cooperating with a contact maneuvering component (18), a middle portion (23) forming an area of application (24*a*) for the control element, wherein the foot (21) of the blade is applied on prop (17) of the case by means of a stiff support (30), the support is fixed to the foot and has a pivoting rest point (32), located at the opposite of the control element with respect to the blade, while an adjustment element (34) stresses the blade in order to adjust the position of it head.

characterized by the fact that the foot (21) of the flexible blade (20) has a folded back extension (27) so as to be elastically applied against a span (36) of the case in order to cause the compression of the blade on the prop (17).

2. The protection relay according to claim 1, characterized by the fact that the extension (27) is folded as a V or U with respect to the main plane (P) of the blade and that the free legs (28, 29) of the V or the U is applied against the span (36).

3. The protection relay according to claim 2, characterized by the fact that the extension (27) is folded beyond an area (26) for fixing the stiff support (30) on the blade (20).

4. The protection relay according to claim 2, characterized by the fact that the extension (27) comprises two symmetrical legs (28, 29) with respect to the symmetry plane (Q) of the blade.

5. The protection relay according to claim 1, characterized by the fact that the pivoting rest point (32) is located along the length of the blade substantially at the level of the area of application (24*a*) of the control element (16).

6. The protection relay according to claim 1, characterized by the fact that the adjustment element (34) has a cam surface (35) applied on the stiff support (30) on the side of the pivoting rest point (32) and is able to rotate around an axis (X3) parallel to the main plane (P) of the blade.

* * * * *